United States Patent [19]

Downing

[11] Patent Number: 4,615,440

[45] Date of Patent: Oct. 7, 1986

[54] TAPPET CARTRIDGE ASSEMBLY CONTAINER AND APPLICATOR

[75] Inventor: Todd R. Downing, Glen Ellyn, Ill.

[73] Assignee: Stanadyne, Inc., Windsor, Conn.

[21] Appl. No.: 729,270

[22] Filed: May 1, 1985

[51] Int. Cl.[4] ..... B65D 65/24

[52] U.S. Cl. ..... 206/229; 29/453; 29/464; 123/90.48; 123/90.55; 206/319; 206/446; 206/820

[58] Field of Search ..... 123/90.48, 90.55, 90.58; 150/52 K; 206/335, 229, 319, 230, 446, 327, 820, 302, 216, 222; 220/212; 29/446, 453, 464, 525

[56] References Cited

U.S. PATENT DOCUMENTS

| | | | |
|---|---|---|---|
| 2,690,947 | 10/1954 | Roehrl | 206/327 X |
| 2,801,891 | 8/1957 | De Lorean | 29/453 |
| 3,977,576 | 8/1976 | Amabili | 29/453 X |
| 4,392,462 | 7/1983 | Lesler | 123/90.55 |
| 4,397,271 | 8/1983 | Gardner | 123/90.55 |
| 4,439,909 | 4/1984 | Borgen et al. | 29/453 |
| 4,465,038 | 8/1984 | Speil | 123/90.55 |

FOREIGN PATENT DOCUMENTS

| | | | |
|---|---|---|---|
| 945183 | 12/1963 | United Kingdom | 206/327 |

*Primary Examiner*—William Price
*Assistant Examiner*—Bryon Gehman
*Attorney, Agent, or Firm*—Kinzer, Plyer, Dorn & McEachran

[57] ABSTRACT

The invention includes a method of retaining, shipping and assembling tappet cartridge assemblies, as well as a plastic sleeve for retaining the tappet cartridge assembly during shipping and assembly. In the method, a plastic sleeve retains an otherwise removable plunger in a tappet cartridge assembly body. The thus-retained cartridge assembly may be shipped and during subsequent assembly is positioned in alignment with a tappet follower. The tappet cartridge assembly is pushed through the retainer plastic sleeve into the tappet follower with such movement releasing the cartridge assembly from the plastic sleeve, permitting removal of the plastic sleeve.

5 Claims, 8 Drawing Figures

Fig. 4.
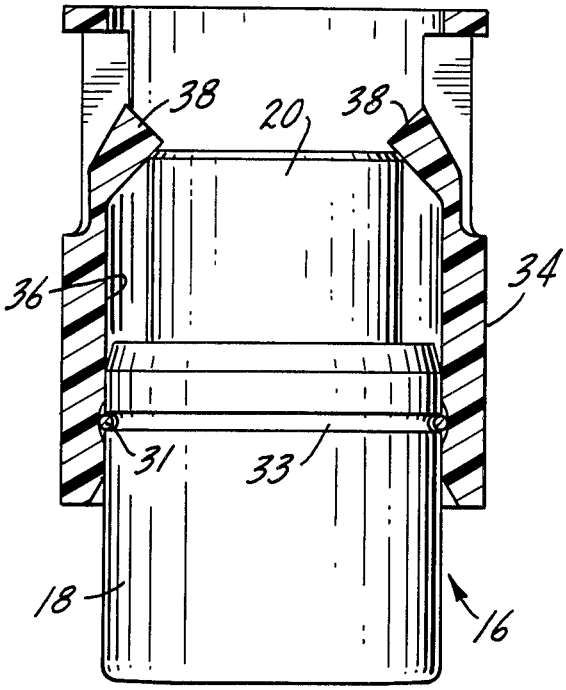
Fig. 6.
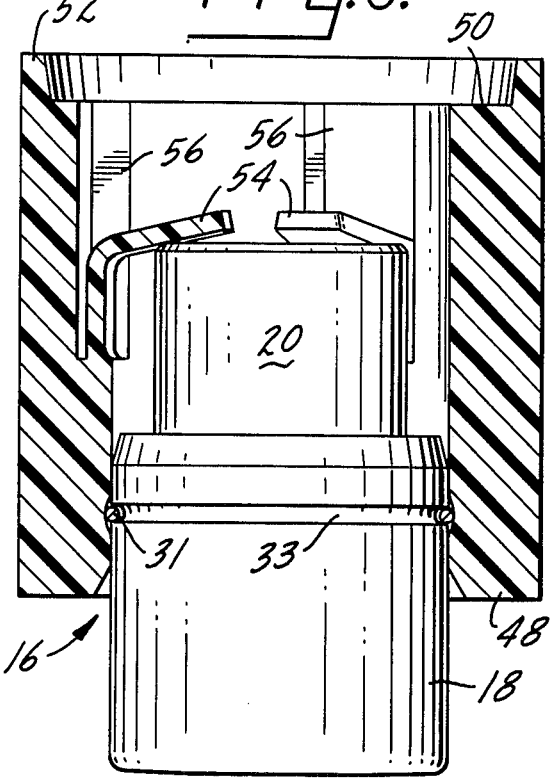
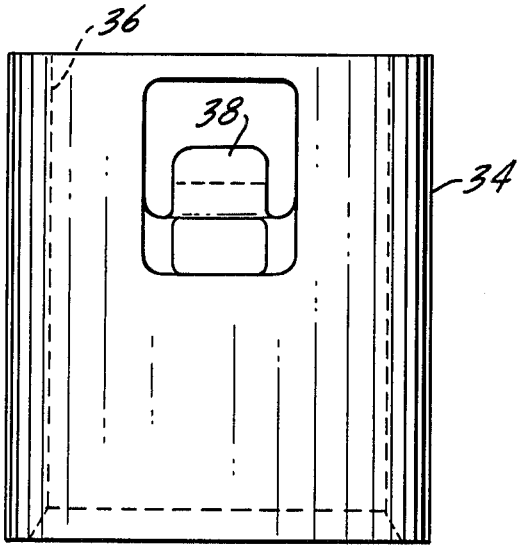
Fig. 5.
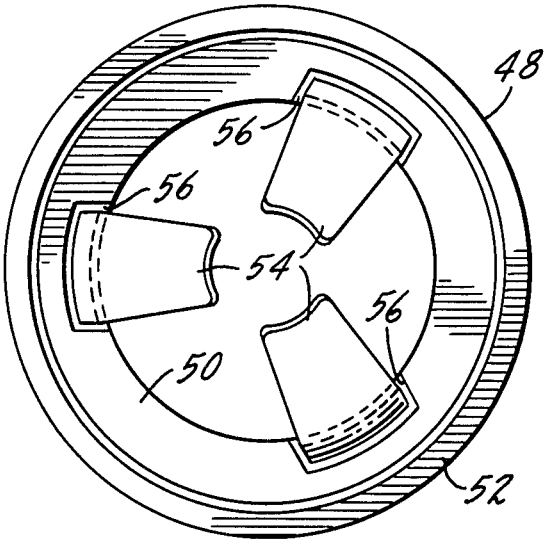
Fig. 7.
Fig. 8.
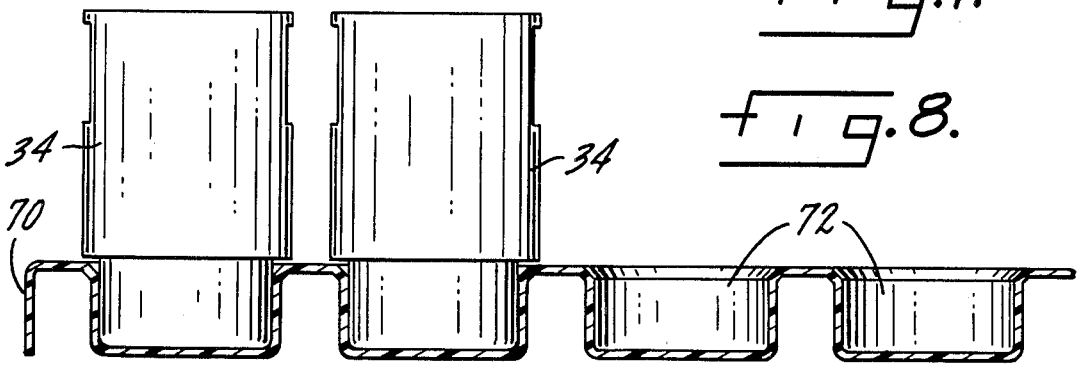

TAPPET CARTRIDGE ASSEMBLY CONTAINER AND APPLICATOR

SUMMARY OF THE INVENTION

The present invention relates to a method and apparatus for retaining, shipping and assembling tappet cartridge assemblies into a tappet follower.

A primary purpose of the invention is a plastic sleeve and a method of using such sleeve in retaining, shipping and assembling a tappet cartridge assembly.

Another purpose is a method of the type described in which the plastic sleeve is disposable and in which the disposable sleeve is stripped from the tappet cartridge assembly during movement of the assembly into the tappet follower.

Another purpose is a method of the type described which permits the shipment of tappet cartridge assemblies with hydraulic fluid therein with the fluid being retained within the cartridge assembly body by the plunger which itself is retained by the plastic sleeve.

Other purposes will appear in the ensuing specification, drawings and claims.

BRIEF DESCRIPTION OF THE DRAWINGS

The invention is illustrated diagrammatically in the following drawings wherein:

FIG. 4 is an axial section, similar to FIG. 1, but showing a modified form of plastic sleeve, FIG. 5 is a side view of the plastic sleeve of FIG. 4, FIG. 6 is an axial section, similar to FIGS. 1 and 4, showing yet a further embodiment of plastic sleeve, FIG. 7 is an end view of the plastic sleeve of FIG 6, and FIG. 8 is a side view of plastic sleeves of FIG. 4 shown in a shipping container.

DESCRIPTION OF THE PREFERRED EMBODIMENT

It is not uncommon in the manufacture of lash adjusters or hydraulic tappets that the tappet cartridge assembly, which is a subassembly of the lash adjuster, be a standard component which may be used in lash adjusters of many different sizes and configurations. Thus, the cartridge assembly or subassembly may be manufactured at one location and shipped to a number of different customers for inclusion into lash adjusters.

The present invention is particularly directed to a means for shipping a cartridge assembly in such a way that the assembly will not lose the hydraulic fluid included therein at the point of initial manufacture and such that the container may be used during subsequent assembly.

More particularly, the cartridge assembly which will consist of a plunger and a body, plus various subcomponents, will be assembled, but not permanently secured together. The plastic sleeve shown and described herein provides the means for retaining the cartridge assembly plunger within the body during shipment so as to prevent loss of hydraulic fluid, as well as to maintain the various components of the subassembly in their assembled position. The plastic sleeve shown and described retains the cartridge assembly in an assembled condition during shipment and provides a means whereby the cartridge assembly may be automatically assembled into a lash adjuster follower, for example by a robot or other form of automatic assembly device.

Figure 1:
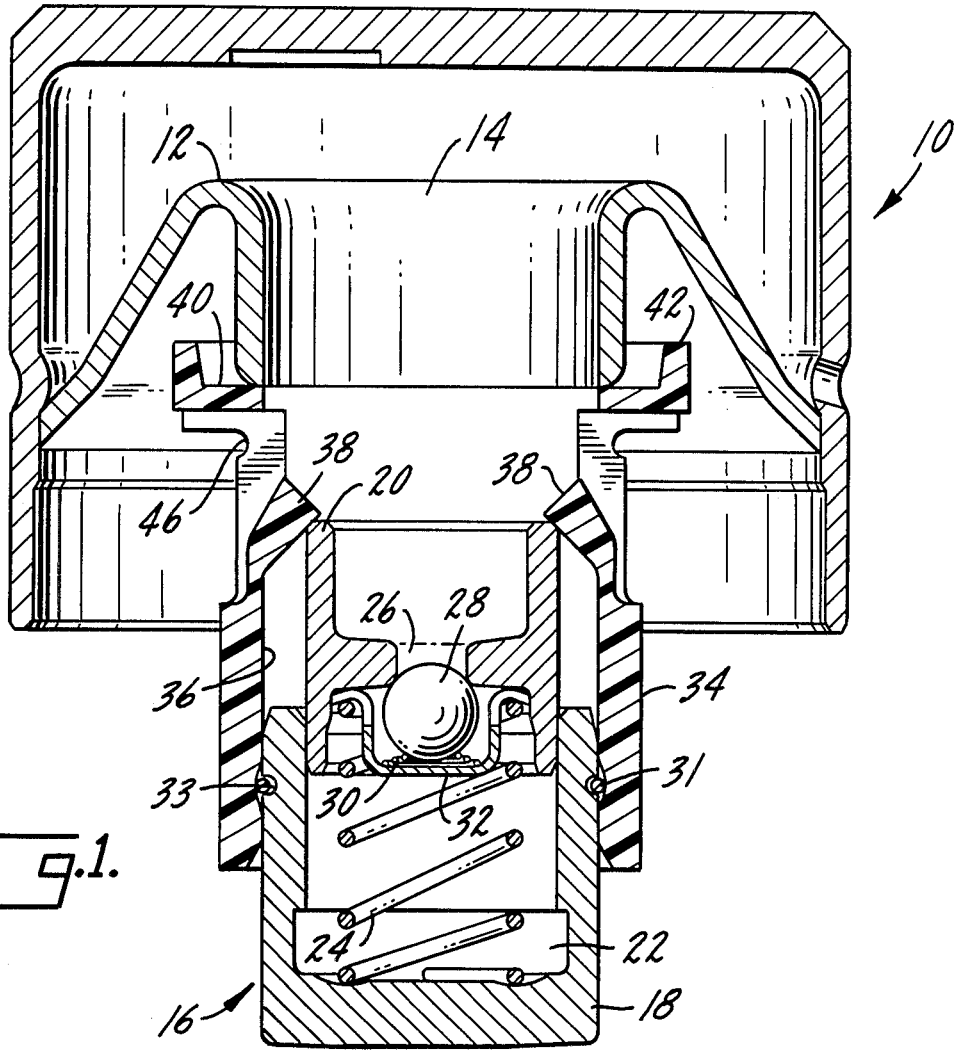
FIG. 1 is an axial section illustrating a tappet cartridge assembly positioned for insertion into a tappet follower, with the cartridge assembly being retained by a plastic sleeve.

Looking at FIG. 1, the follower of the lash adjuster is indicated at 10 and may be of a conventional configuration. The follower 10 may have a spacer 12 which defines a bore 14 which will receive the cartridge assembly indicated generally at 16. The cartridge assembly 16 includes a body 18 and a reciprocal plunger 20. The cartridge assembly may be of the type shown in U.S. Pat. No. 4,397,271. Formed between plunger 20 and body 18 is a high pressure chamber 22 within which is positioned a coil spring 24 which normally biases the plunger outwardly from body 18. Plunger 20 has an oil passage 26 which is controlled by a check valve in the form of a ball 28 urged to a passage closing position by a coil spring 30 held in position by a retainer 32. A retainer ring 31 is positioned within a groove 33 in the exterior of body 18, with the retainer ring being used to hold the body in follower 10 after assembly.

Cartridge assembly 16 will be shipped in an upright position with hydraulic fluid within chamber 22. A plastic sleeve 34 has an internal diameter 36 which is sized and shaped to snugly hold body 18. A sleeve recess 35 is formed by the retainer ring 31. The firm fit of sleeve 34 on body 18 and the combination of retainer ring 31 and recess 35 together hold the cartridge assembly in the sleeve.

Figure 2:
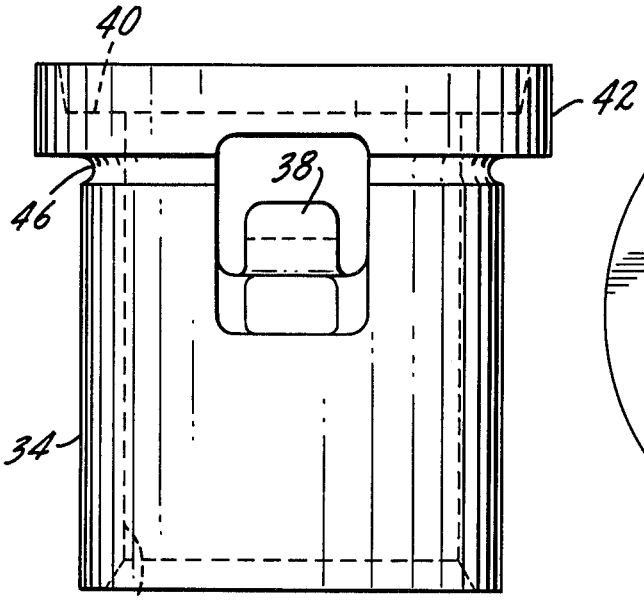
FIG. 2 is a side view of the plastic sleeve used in the embodiment of FIG. 1.
Figure 3:
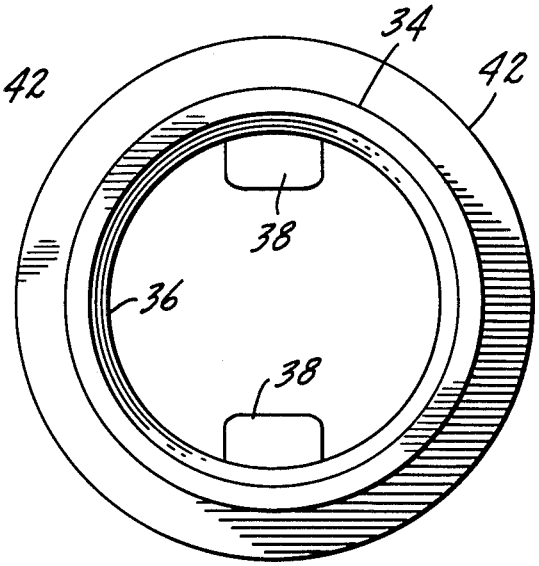
FIG. 3 is an end view of the plastic sleeve of FIGS. 1 and 2.

The plastic sleeve may have a plurality, for example two in the embodiment of FIGS. 1–3, in-turned tabs 38 which are integral with and cut out from the sleeve, as shown more particularly in FIGS. 2 and 3. The in-turned tabs 38 are positioned to prevent the removal of plunger 20 from body 18, thus retaining the cartridge in an assembled condition. The number of tabs and their precise construction may vary. What is important is that the tabs maintain the body and plunger in an assembled condition to prevent the loss of hydraulic fluid from the high pressure chamber.

One end of sleeve 34 may have an annular shoulder 40 which will abut the end of spacer 12 when the cartridge assembly is positioned for insertion in the follower. Shoulder 40 may have an axially-extending outward flange 42 which will extend outside of the cylindrical portion of spacer 12 when the cartridge assembly and its associated plastic sleeve are positioned for insertion within the follower.

The cartridge assemblies described, retained by plastic sleeve 34, may be shipped in a tray in which there are multiples of such assemblies, such as shown in FIG. 8. A robot or some other form of assembly device may secure a plurality of such cartridge assemblies and position them for insertion into the followers. When so positioned the plastic sleeve will abut the end of spacer 12 and be aligned with the opening therein. The cartridge assemblies are then pushed into the followers by the application of a force on the free end of body 18. This will have the effect of forcing the cartridge assembly past tabs 38 and into follower 10 to a fully assembled position. Retainer ring 31, in the fully assembled position, will be beyond spacer 12. After the cartridge assembly is so moved, the plastic sleeve will no longer be held by or onto the cartridge assembly, but, rather, will be free for subsequent removal.

The plastic sleeve may be made of a variety of different materials. One satisfactory material is a plastic known as 6,6 Nylon, heat stabilized. What is essential is that the plastic be resistant to the chemicals within conventional hydraulic fluids and also that it be resistant to cuts and abrasion and possible shaving caused by the rapid movement of the cartridge assembly through it during the final assembly process.

FIGS. 4 and 5 illustrate a variation on the plastic sleeve illustrated in FIGS. 1–3. In this case, annular shoulder 40 does not have the axially-extending flange 42 and the die set groove 46 of the FIG. 1–3 embodiment has been removed, as it is no longer required to remove the plastic sleeve from a die during molding thereof. In other respects, the sleeve, as well as the tappet cartridge assembly, are the same.

In FIGS. 6 and 7, plastic sleeve 48 again has an annular shoulder 50 and an axially-extending flange 52. In this case, the in-turned tabs, rather than being cut-outs, as in the earlier described embodiments, are integral arms indicated at 54 which are inwardly bent to hold the cartridge assembly plunger as described. There are no openings or holes in the body of the sleeve, but, rather, there are a plurality, in this case three, axially-extending interior grooves 56 on the inside of the sleeve, which grooves are of a size and shape to receive the arms. In the assembly process the arms will be folded back into grooves 56 when the cartridge assembly is pushed or forced through the sleeve into the lash adjuster follower.

The number of tabs and their precise construction may vary. What is important is that there be a means for firmly holding the cartridge assembly plunger within the body, with the plastic sleeve being firmly about the cartridge assembly body. Thus, there is a means for retaining and shipping and providing a means for facilitating assembly of the lash adjuster cartridge assembly into the lash adjuster follower.

In FIG. 8, a plurality of cartridge assemblies of the type shown in FIGS. 4 and 5 are positioned within a tray or container 70 having a group of receptacles 72 formed and adapted to hold the cartridge assemblies.

Whereas the preferred form of the invention has been shown and described herein, it should be realized that there may be many modifications, substitutions and alterations thereto.

The embodiments of the invention in which an exclusive property or privilege is claimed are defined as follows:

1. A disposable plastic member for use in retaining, shipping and assembling a tappet cartridge assembly into a tappet follower including a cylindrical sleeve of a size and shape to closely fit about the cartridge assembly body, in-turned portions integral with said sleeve for retaining the cartridge assembly plunger within the assembly body, said sleeve having an end portion formed and adapted to abut the tappet follower during assembly to permit the cartridge assembly to be driven through the sleeve into the follower.

2. The disposable plastic member of claim 1 further characterized in that the sleeve in-turned portions are cut-out tabs.

3. The disposable plastic member of claim 1 further characterized in that said sleeve in-turned portions are integral with and folded internally from the sleeve toward the center thereof to hold the cartridge assembly plunger within the assembly body, with said in-turned portions being folded back toward the sleeve when the cartridge assembly is driven through the sleeve into the tappet follower.

4. The disposable plastic member of claim 1 further characterized in that said end portion includes an annular shoulder adapted to face the tappet follower during assembly.

5. The disposable plastic member of claim 1 further characterized by and including an axially extending flange integral with said shoulder and extending outwardly from the plastic sleeve and toward the tappet follower during assembly.

* * * * *